US006409170B1

(12) United States Patent
Sugimoto

(10) Patent No.: US 6,409,170 B1
(45) Date of Patent: Jun. 25, 2002

(54) GAMING MACHINE

(75) Inventor: Kiyoshi Sugimoto, Tokyo (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/212,448

(22) Filed: Dec. 16, 1998

(30) Foreign Application Priority Data

Dec. 18, 1997 (JP) ..... 9-349512

(51) Int. Cl.[7] ..... A63F 5/04; A63F 7/02
(52) U.S. Cl. ..... 273/143 R
(58) Field of Search ..... 463/16–20; 273/143 R, 273/138.1, 138.2, 138 A; 40/323

(56) References Cited

U.S. PATENT DOCUMENTS

| | | | | | |
|---|---|---|---|---|---|
| 1,477,708 | A | * | 12/1923 | Larson | 40/323 |
| 1,665,132 | A | * | 4/1928 | Fisher | 40/323 |
| 1,875,931 | A | * | 9/1932 | Mihalka et al. | 40/323 |
| D112,152 | S | * | 11/1938 | Sandley | 40/323 |
| 2,448,982 | A | * | 9/1948 | Jensen | 40/323 |
| 5,516,293 | A | * | 5/1996 | Heidel et al. | 273/143 R |

FOREIGN PATENT DOCUMENTS

| | | | | |
|---|---|---|---|---|
| JP | 6-261973 | * | 9/1994 | 273/143 R |
| JP | 10-174738 | * | 6/1998 | 273/143 R |

* cited by examiner

*Primary Examiner*—Jessica Harrison
(74) *Attorney, Agent, or Firm*—Rohm & Monsanto, P.L.C.

(57) ABSTRACT

A gaming machine that is provided with an outlet for paying out gaming media has a receiver for paying-out the gaming media, the receiver being disposed forward of the outlet. The receiver is illuminated so was to permit the player to view the gaming media that has been collected in the receiver, whereby the amount thereof readily can be confirmed. Illumination of the receiver is achieved from within the gaming machine, the illumination being emitted from the outlet for paying the gaming media. Thus, as the gaming media is paid out, a glistening effect that is entertaining and visually pleasing is created. Illumination of the receiver, which may be in the form of a receiver tray, is effected, in one form of the invention, by an internal source of illumination that also illuminates the front panel of the gaming machine. Light is propagated through a transmission element to the receiver. In a preferred form, a further light source is disposed behind the chute via which the gaming media is provided to the outlet. Depending upon the location of the further light source with respect to the chute, multiple reflections are employed within the chute to deliver the light to the outlet. The coloration of the light that is delivered to the outlet may be controlled by the further light source itself or a colored transmission element. This permits interesting decorative coloration schemes to be effected, thereby raising the player's interest in playing the game.

11 Claims, 7 Drawing Sheets

GAMING MACHINE

BACKGROUND OF THE INVENTION

1. Field of the Invention

This invention relates generally to gaming machines, such as slot machines and pachinko gaming machines, and more particularly to gaming machines that use gaming media, such as coins or a gaming ball.

2. Description of the Related Art

A known slot machine has a main body on which disposed a variable display that is arranged to have several reels that include various kinds of displayed symbols, and a front door that can be opened and shut freely and that is fixed to the main body of the slot machine. The front door is provided with a synthetic resin frame fitted with a transparent indication panel and a translucent decorative panel therein. For example, a translucent plastic board that may be colored or decorated is used as the decorative panel. In this embodiment, the decorative effect of the decorative panel is enhanced by illumination from a fluorescent lamp disposed behind the decorative panel.

In the above slot machine, coins or medals are used as the gaming media. Before the game is started, a coin is inserted into a coin slot and a start lever is operated by a player. These actions initiate the variable indication of various kinds of symbols. The variable indication of symbols is stopped by operation of a stop button by the player, or by passage of a predetermined period. A standstill state of the symbols is indicated by an indication window on the indication panel of the slot machine. If a combination of symbols is present in the indication window when the variable display has been stopped corresponding to a winning prize, a number of coins predetermined for the winning prize begin to be paid out from within the main body of the slot machine into a coin receiving tray disposed at the bottom of the front door.

A decorative panel positioned above the coin receiving tray is illuminated by a fluorescent lamp that is internal to the slot machine. However, in known slot machines, such illumination by the fluorescent lamp will not illuminate the coin receiving tray. It serves only to achieve a decorative effect. Accordingly, the known slot machine has a disadvantage in that it is difficult to identify the number of coins paid out by the coin payout outlet to the coin receiving tray.

In Japanese Patent Application Kokai (Laid-Open)No. 6-261973, a structure is disclosed in which a light induction board (illustratively an acrylic acid resin board) is disposed in the bottom interior of the front door frame of the slot machine. The front door accommodates a decorative panel therein. The end portion of the light induction board is indicated as protruding outwardly. By this known arrangement, the light is propagated within the light induction board toward the coin receiving tray, whereupon same is illuminated.

It is a disadvantage of this known arrangement that the illumination of the tray by the light induction board is insufficient due to propagation losses within the light induction board. Light is absorbed within the light induction board due to many reflections therewithin. In short, the light supplied from the end of the light induction board achieves a decorative effect, but does not have enough illuminating power to illuminate the coin receiving tray. Such weak illumination of the coin receiving tray precludes even the attentive player from viewing the outlet of the paid-out coins.

SUMMARY OF THE INVENTION

It is, therefore, an object of this invention is to provide a gaming machine wherein a player readily can confirm gaming media collected in a coin receiving tray of the gaming machine. This is achieved by an illumination arrangement that illuminates the receiving tray fully. The illumination arrangement of the present invention additionally achieves a decorative and entertaining effect during the payment of gaming media that catches the attention of the player.

In accordance with the invention, a gaming machine is provided with an outlet for paying out gaming media, and a receiver for the paid-out gaming media that is disposed forward the outlet. Additionally, there is provided an illumination arrangement that supplies light from the interior of the outlet toward the receiver.

The illumination arrangement of the present invention illuminates the receiver without significant attenuation of the illuminating power of the light source that would result from multiple reflections within the interior of the outlet as the light is propagated toward the receiver. Thus, the player can easily confirm how much gaming medium is stored in the receiver. In addition to the above, in embodiments of the invention where the gaming medium is formed of a material that reflects the light, a decorative and entertaining effect is achieved when the glistening gaming medium comes out from within the outlet.

In an embodiment where an illumination arrangement includes an internal light source for illuminating a decorative panel disposed on the front surface of the gaming machine and a reflection surface for reflecting light from the internal light source toward the outlet of paid-out gaming media, the light from the internal light source is propagated toward the interior of the outlet. The light is reflected therewithin as it is propagated toward the receiver of the paid-out gaming media. This structure is economical because only light source(s) internal to the main body of the gaming machine are used, without requiring any significant modification to the internal structure.

In a further embodiment of the present inventive illumination arrangement, an internal light source is provided for illuminating a decorative panel disposed on the front surface of the gaming machine, an optical transmission member that transmits light from the internal light source inside the outlet of the paid-out gaming media, and a reflection surface for reflecting the light transmitted inside the outlet of paid-out gaming media toward the outlet of paid-out gaming media. The light from the internal light source propagates through an optical transmission member to the interior of the outlet. After one or more reflections within the outlet, the light illuminates the receiver. In such an embodiment, the optical transmission member may be colored whereby the light that passes therethrough has a color different from that of the internal light source. This use of coloration can increase the decorative effect.

In a still further arrangement in which the illumination arrangement is provided with a further light source additional to the internal light source that illuminates the decorative panel disposed on the front surface of the gaming machine. In this embodiment, the reflection surface reflects only the light from the additional light source. An entertaining effect is achieved wherein the further light source emits light from the interior of the outlet that illuminates the gaming medium as it is paid out. This additional light source can be operated independently of the principal internal light source. The novel illumination arrangement can be configured so that only light from the additional light source is supplied to the outlet. This can be achieved by obstructing the light from the principal internal light source.

It is desirable that the reflection surface be formed in the interior of a chute for paying-out gaming media, which chute constitutes a passage for the gaming media. In a practical embodiment, the chute is disposed behind the outlet for the paying out of gaming media. This embodiment is economical as there is no need to prepare a separate reflection surface, because the reflection surface is formed on the interior of the chute behind the outlet.

In yet another embodiment where the illumination arrangement is provided with a light source disposed outside a lower position of the chute to supply light from the outlet toward the receiver, the illumination arrangement does not require a reflection surface because the light from the light source is directed toward the outlet. Moreover, the illumination arrangement does not impede the passage of gaming media in the chute because the light source is disposed behind the chute.

In embodiments where the illumination arrangement is provided with a light source arranged at an upper position of the chute, the illumination arrangement does not impede the gaming media in the chute, and will employ reflections to illuminate the receiver fully.

Brief Description of the Drawing

Comprehension of the invention is facilitated by reading the following detailed description, with the annexed drawing, in which.

DETAILED DESCRIPTION

The following is a detailed description of a specific illustrative embodiment of the invention applied in a slot machine.

Figure 1:
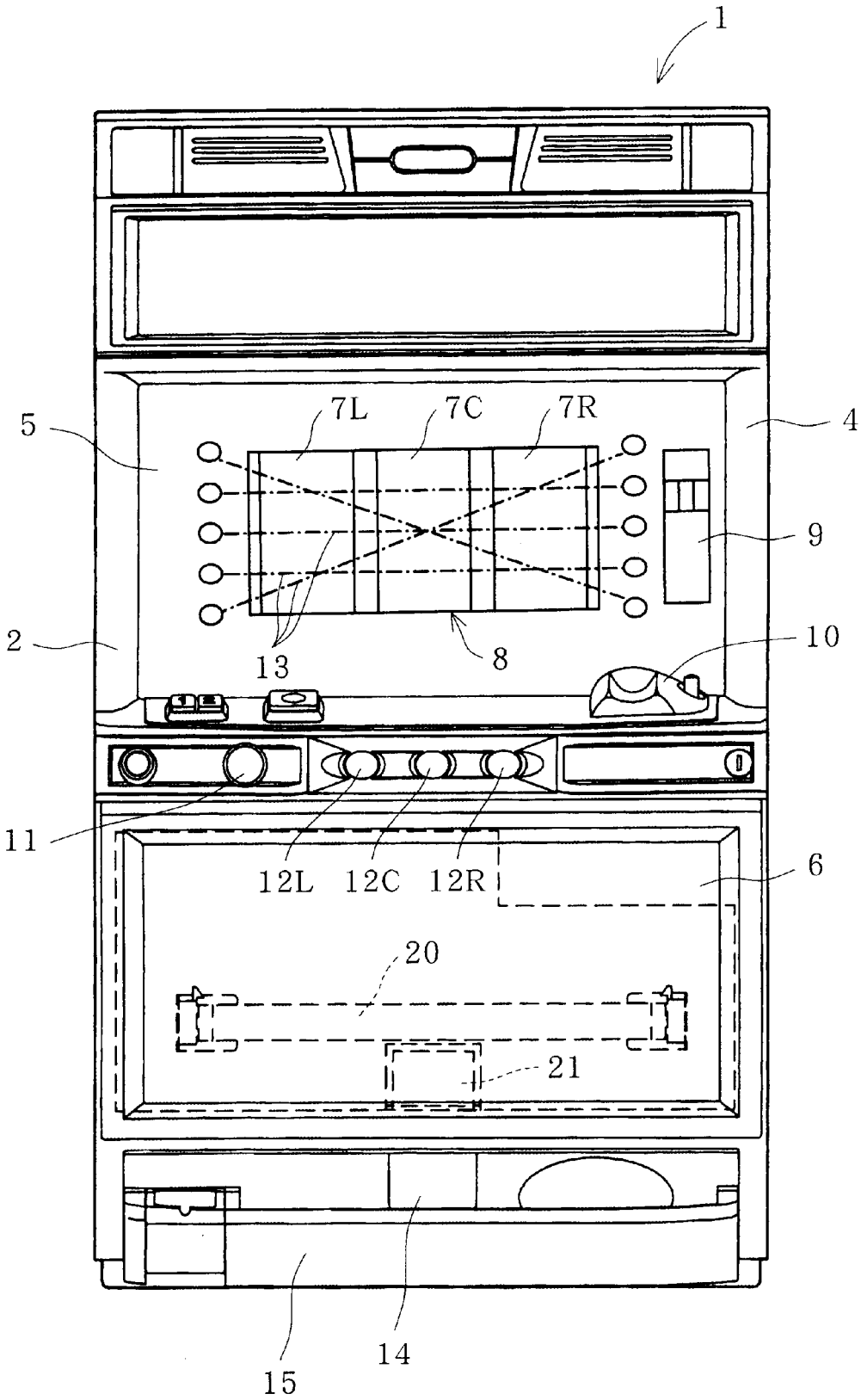
FIG. 1 is a plan representation showing a front view that illustrates an embodiment of a slot machine constructed in accordance with the principles of the present invention.
Figure 2:
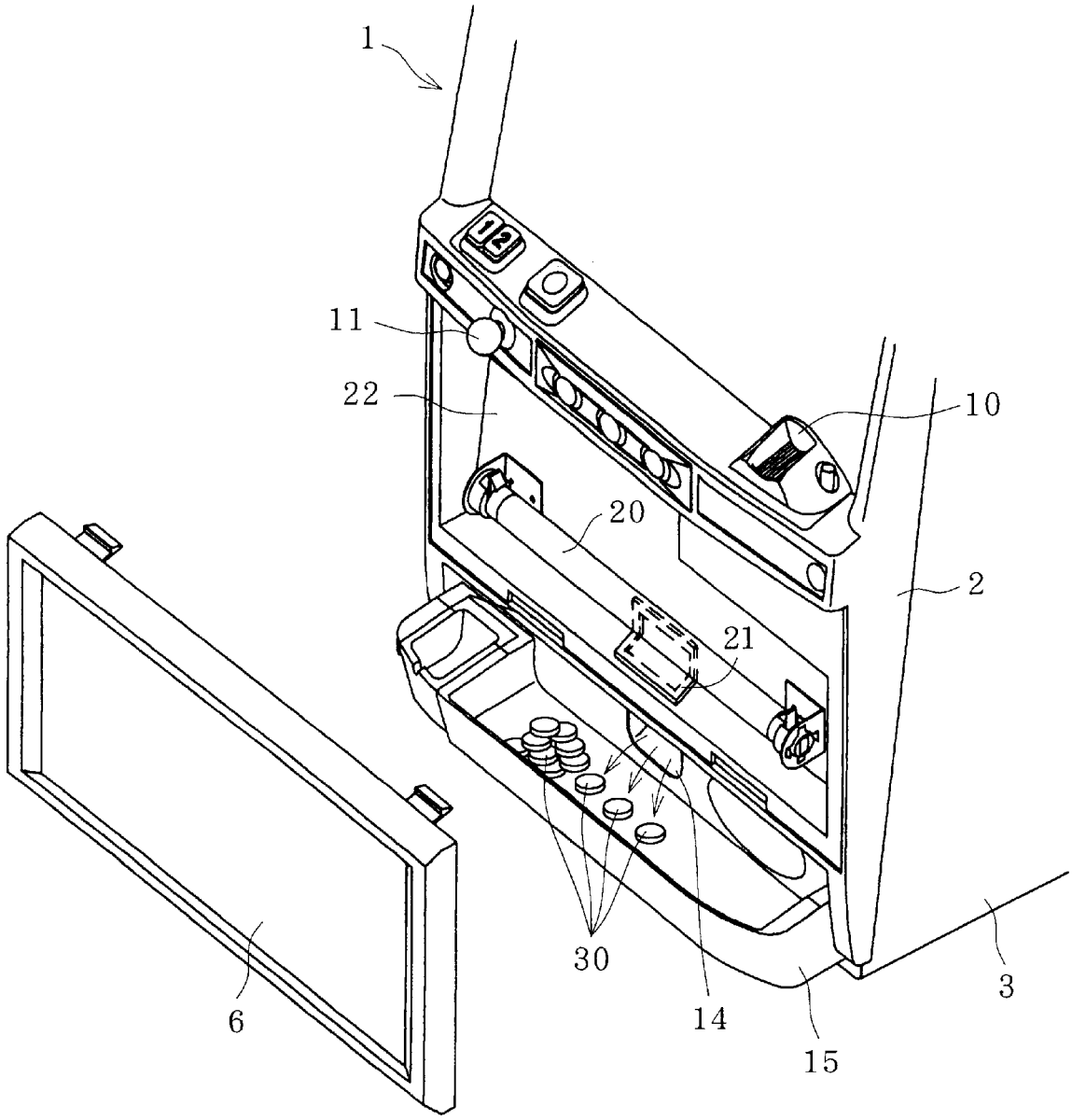
FIG. 2 is a perspective to representation that shows the lower portion of the slot machine of FIG. 1, wherein the decorative panel has been removed.

FIG. 1 is a plan representation showing a front view that illustrates an embodiment of a slot machine constructed in accordance with the principles of the present invention. As shown in this figure, a slot machine 1 is provided with a main body 3 (also shown in FIG. 2 ) in the form of a housing, and it is arranged to have a reel unit formed of three reels 7L, 7C, and 7R on a front door 2. There additionally are provided other arrangements or devices on front door 2, including a synthetic resin frame 4 configured with a decorative treatment having the outward appearance of metal (not shown) by the application of a plating material. An indication panel 5 is disposed in front of the three reels, and a decorative panel 6 is fixed in frame 4. Decorative panel 6 is formed of a translucent plastic board colored or decorated so that the interior of main body 3 cannot be viewed from the outside. A fluorescent lamp 20 is arranged as an internal light source to increase the decorative effect behind decorative panel 6.

A reel window 8 is provided on an indication panel 5 of front door 2 for permitting viewing of reels 7L, 7C, and 7R. The indication panel additionally permits viewing of a counter readout 9 that provides indication of the number of coins paid-out, as well as indication of the allotted number of coins in the winning prize. Other equipment can be disposed on indication panel 5. A coin input slot 10 is disposed in frame 4, and a player can insert one or more coins 30 as gaming medium (shown in FIG. 2) into the coin input slot. In this embodiment, one to three coins are inserted when a game is commenced. After the coins are inserted, the player can operate a start lever 11 to initiate rotation of the reels.

Upon actuation of start lever 11, reels 7L, 7C, and 7R rotate simultaneously. When all reels 7L, 7C, and 7R reach the predetermined condition of rotation, which may be the rotating speed or the number of rotations, the functionality of the stop buttons is activated and the operator may manipulate any of three stop buttons 12L, 12C, and 12R. Each of the stop buttons corresponds to a respectively associated reel. After each of three stop buttons 12L, 12C, and 12R has been actuated by the player, the rotation of each reel 7L, 7C, and 7R is stopped, the point of stopping of each reel being responsive to the timing of the button pushing operation by the operator.

Various kinds of symbols, for example, "7", "BAR", "Cherry", and so on, are painted on each reel 7L, 7C, and 7R. The symbols are indicated in reel window 8 in arrays that correspond to the several winning prize lines 13. These lines are effective to determine whether there has been a win, the amount of the win being responsive to the number of coins inserted when the winning prize is determined. When two or more symbols that stand on one of lines 13 are arrayed as a winning combination on line 13, a well-known hopper (not shown in this figure) in the gaming machine becomes operational and pays coins 30 in an amount responsive to the predetermined value of the winning prize.

Figure 3:
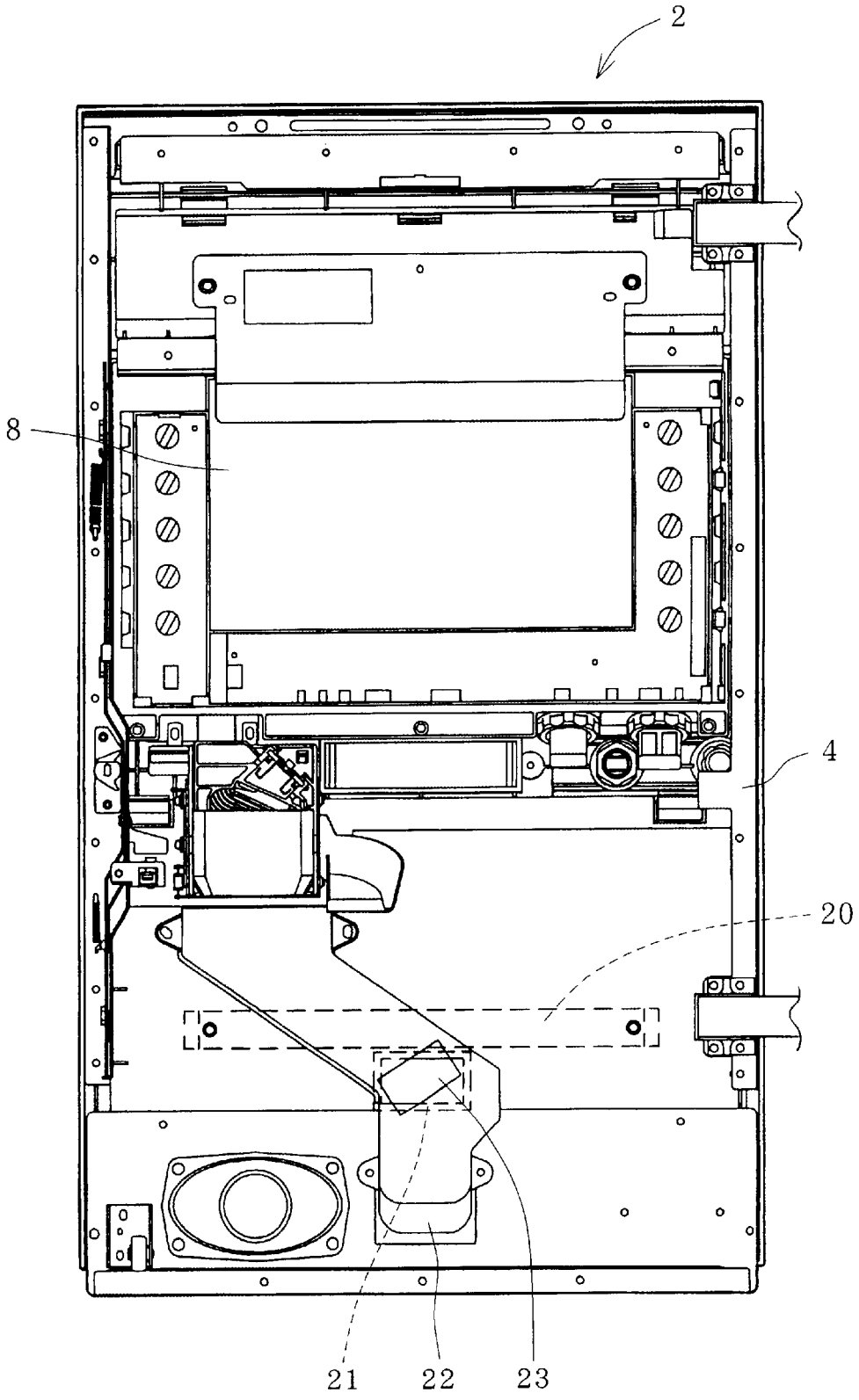
FIG. 3 is a representation of the interior of the front door of the slot machine of FIG. 1.

More specifically, one or more coins 30 are ejected via the hopper and enter an opening 23 of a chute 22 for paying-out coins ( see, FIG. 3 ). Chute 22 is a passageway for coins and is disposed behind and outlet 14 for the coins that are to be paid out. As shown, outlet 14 is disposed into the central lower region of front door 2. As can be seen from FIG. 3, outlet 14 (not shown in this figure) is arranged near the outlet of chute 22, whereby the coins are paid out from outlet 14 and deposited in a coin receiving tray 15 that is disposed forward of the lower position of main body 3.

Figure 4:
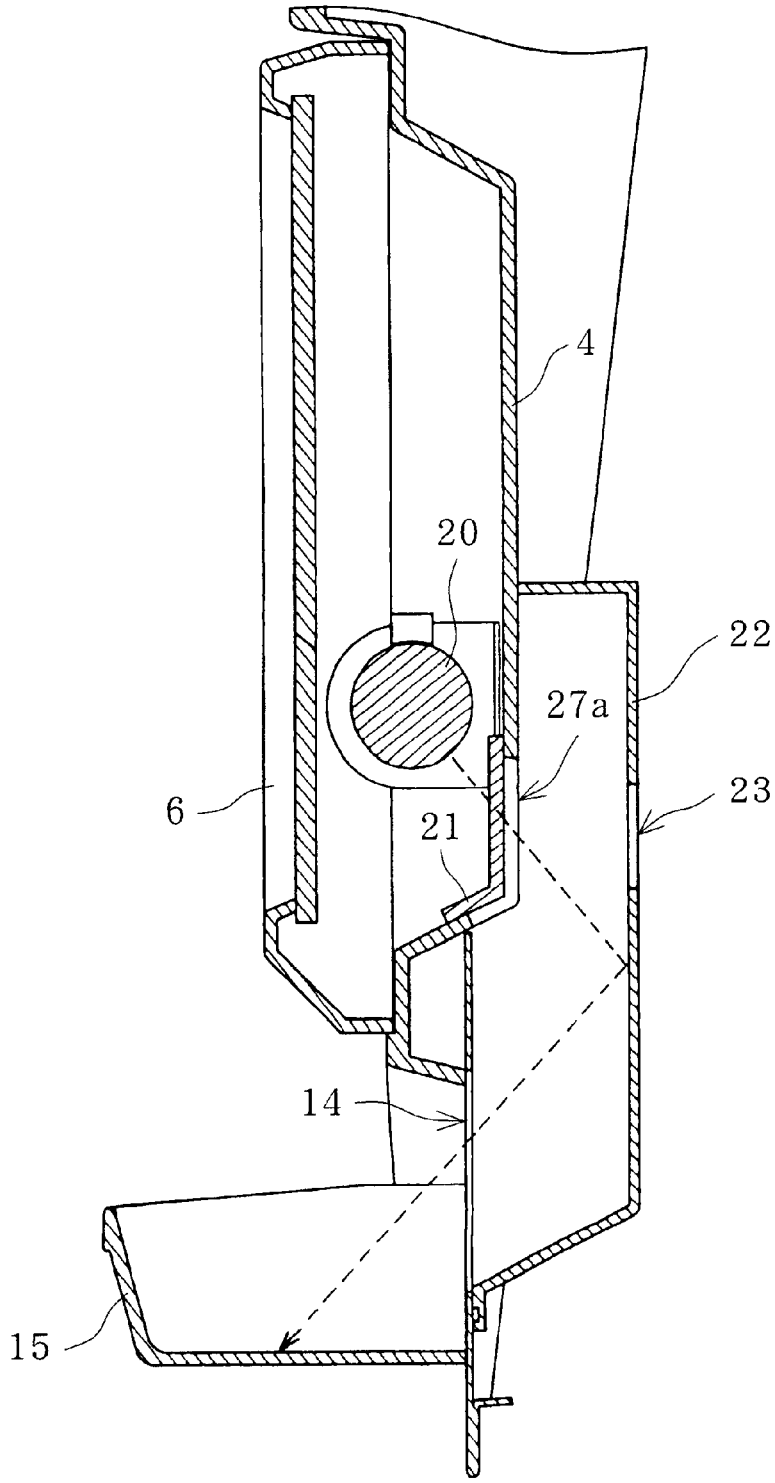
FIG. 4 is a partially cross-sectional side representation showing an embodiment of a longitudinal section of the lower portion of the slot machine of FIG. 1.

FIG. 4 is a partially cross-sectional side representation showing an embodiment of a longitudinal section of the lower portion of the slot machine of FIG. 1. In this specific illustrative embodiment, there is shown to be provided an illumination arrangement that uses a fluorescent lamp 20 as a source of light that illuminates tray 15. The light is supplied via the interior of outlet 14. The illumination arrangement is provided with an aperture 27*a* disposed at the lower portion of a frame 4 of front door 2 through which the light is transmitted whereby some light emitted from fluorescent lamp 20 is propagated to the interior of chute 22. The interior of chute 22 preferably is made from a metal, a plated material, or any other suitable material that will function to reflect the light that enters chute 22 after being propagated through aperture 27*a* substantially toward outlet 14. The path of the light is generally shown by a dashed line in FIG. 4.

In the specific illustrative slot machine described hereinabove, when a power supply (not shown) is energized, fluorescent lamp 20 is turned on and the decorative panel is illuminated. Simultaneously, the light is propagated from the interior of outlet 14 to illuminate tray 15. Thus, a player readily can see coins 30 being deposited into tray 15, and easily can confirm the amount being paid out. It is an additional feature of the present invention that a decorative effect is achieved when coins 30 are being paid out, as a result of the metallic glistening effect resulting from the reflection of the light that impinges thereon from the interior of outlet 14.

It is desirable that the front of aperture 27*a* formed through the lower part of frame 4 of front door 2 be provided with an optical transmission sheet 21 to prevent that coin 30 that enters the chute 22 from opening 23 accidentally enter aperture 27*a*. In embodiments of the invention where optical transmission sheet 21 is formed of a transparent board made from a colored acrylic acid resin, the ability of a player to confirm the number of coins being deposited into tray 15 and of the visual decorative effect are enhanced by the coloration added to the light of fluorescent lamp 20 by decorative panel 16 that, as previously stated, is supplied from within outlet 14 toward tray 15. It is to be understood that light sources other than fluorescent lamps may be used in the practice of the invention.

Figure 5:
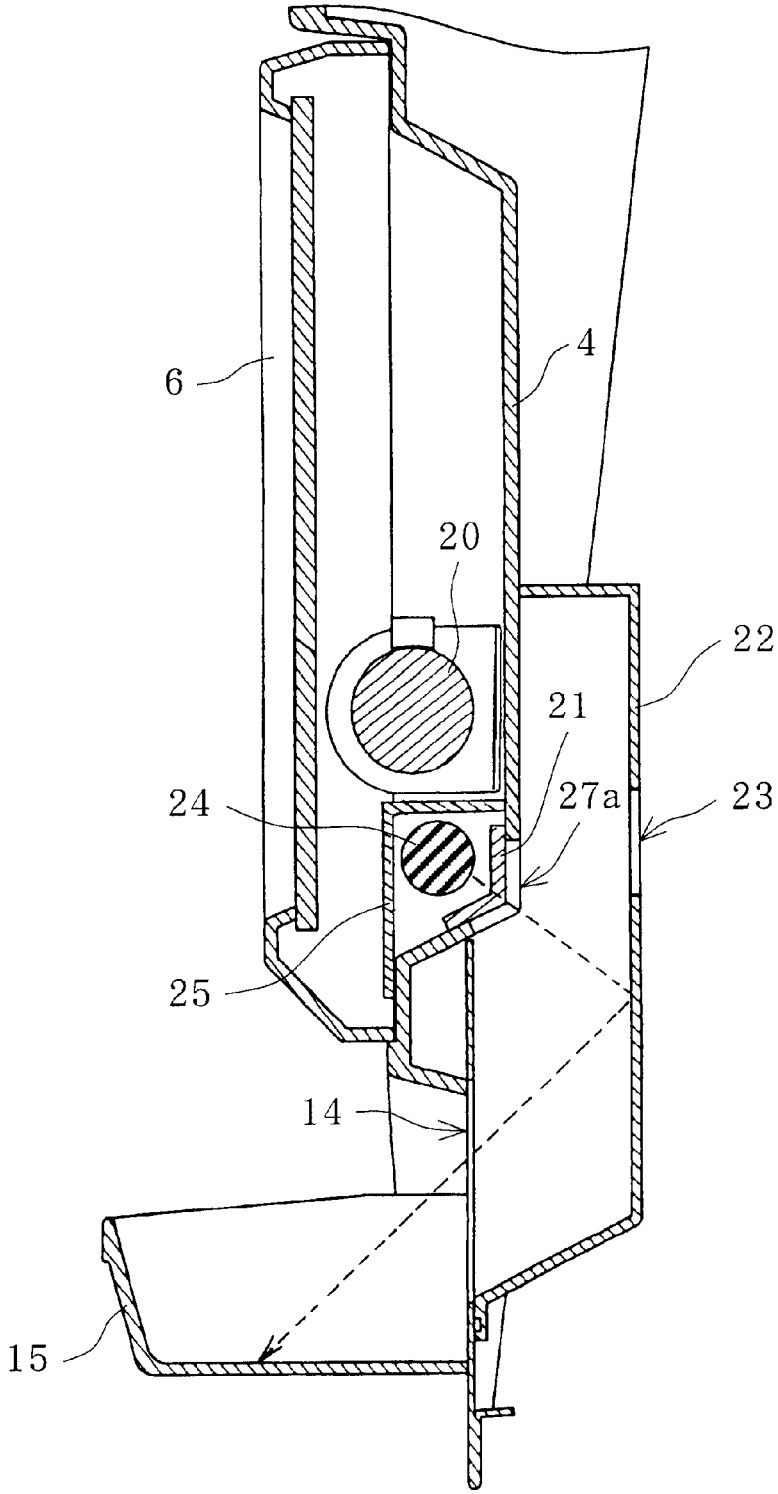
FIG. 5 is a partially cross-sectional side representation showing a second embodiment of a longitudinal section of the lower portion of the slot machine of the present invention.

FIG. 5 is a partially cross-sectional side representation showing a second embodiment of a longitudinal section of the lower portion of the slot machine of the present invention. As shown in this figure, a second light source 24, in addition to fluorescent lamp 20, is disposed in the lower portion of frame 4 of front door 2. The second light source is arranged, in this embodiment, beneath fluorescent lamp 20 to, and has a cover 25 arranged thereover. In this specific illustrative embodiment, only the light from second light source 24 is propagated toward chute 22 from aperture 27*a*. In this embodiment, even if fluorescent lamp 20 is always turned on when power to the gaming machine is switched on, second light source 24 will illuminate the vicinity of tray 15. Second light source 24 can be operated independently of fluorescent lamp 20. As previously indicated, the visual effect achieved by the sparkling characteristic of coins 30, during payout of a winning prize can be achieved even if only second light source 24 is turned on when coins 30 are paid out.

Figure 6:
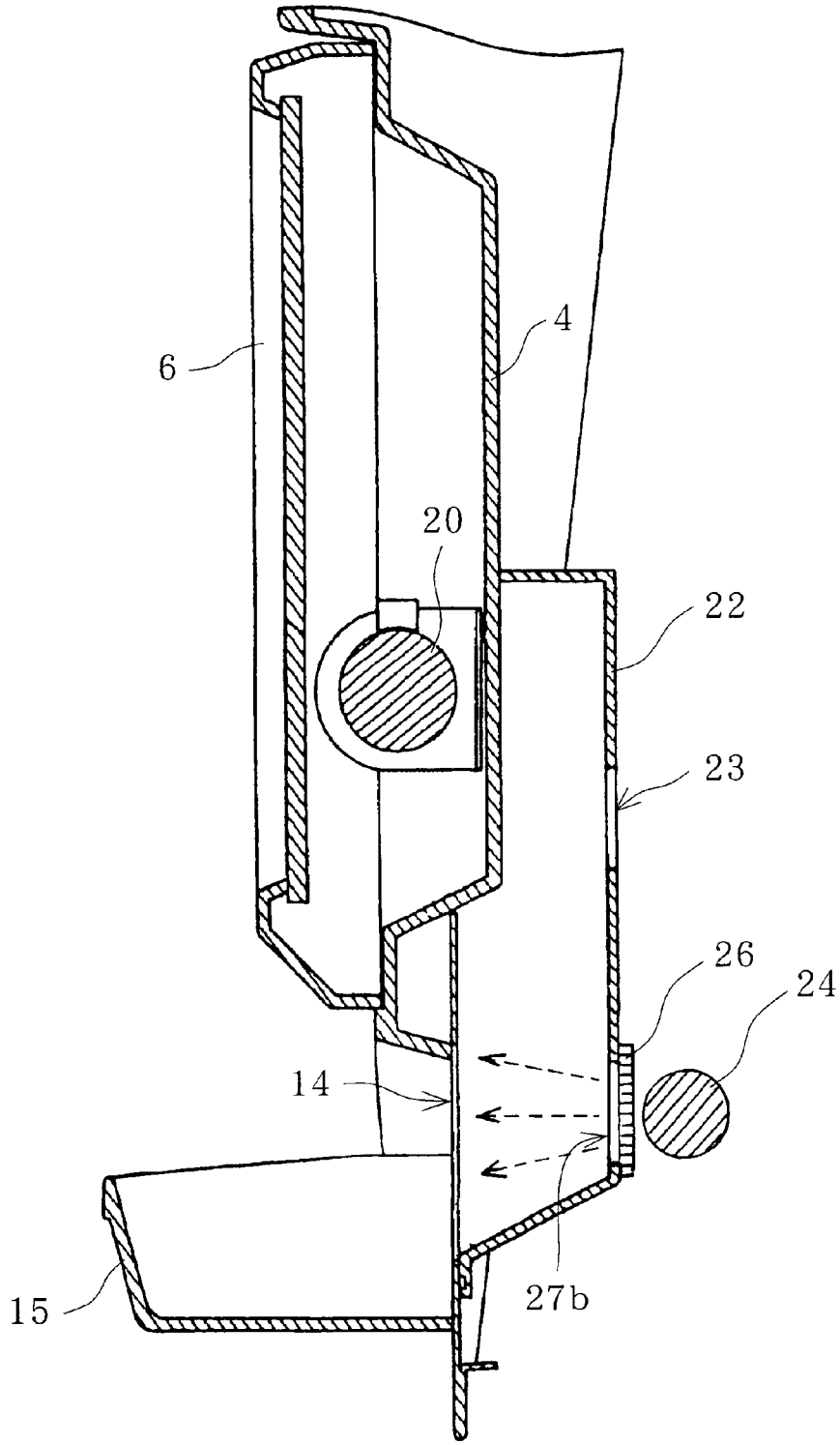
FIG. 6 is a partially cross-sectional side representation showing a third embodiment of a longitudinal section of the lower portion of the slot machine of the present invention.

FIG. 6 is a partially cross-sectional side representation showing a third embodiment of a longitudinal section of the lower portion of the slot machine of the present invention. As shown, second light source 24 may be disposed outside chute 22. In this embodiment, a pleasant instrument of illumination, such as a fluorescent lamp or a light bulb, is used as second light source 24, and is shown in this figure to be disposed outside the lower position of chute 22. An aperture 27*b* is formed between second light source 24 and chute 22. In this specific embodiment, aperture 27*b* is covered by a translucent board 26, which has many surface pits (not shown) for diffusing the light. Translucent board 26 does not preclude coins 30 from being passed through chute 22, notwithstanding that the coins, which are made from materials such as metals characterized with high hardness, may collide therewith. In one embodiment of the invention, board 26 is made of a metal or hard resin, the board material having a multiplicity of small apertures therethrough for permitting passage of the light.

The light issued by second light source 24 is propagated through board 26, and is caused to enter chute 22. The light then is caused to be emitted from outlet 14. In addition, the tray is illuminated, as previously described. The illumination from second light source 24 is shown by a plurality of dashed lines in FIG. 6. In addition to the foregoing, tray 15 can be illuminated by light of any color, which may be emitted directly by second light source 24, or by the application of a predetermined coloration to board 26, as described hereinabove with respect to the embodiment of FIG. 4.

Figure 7:
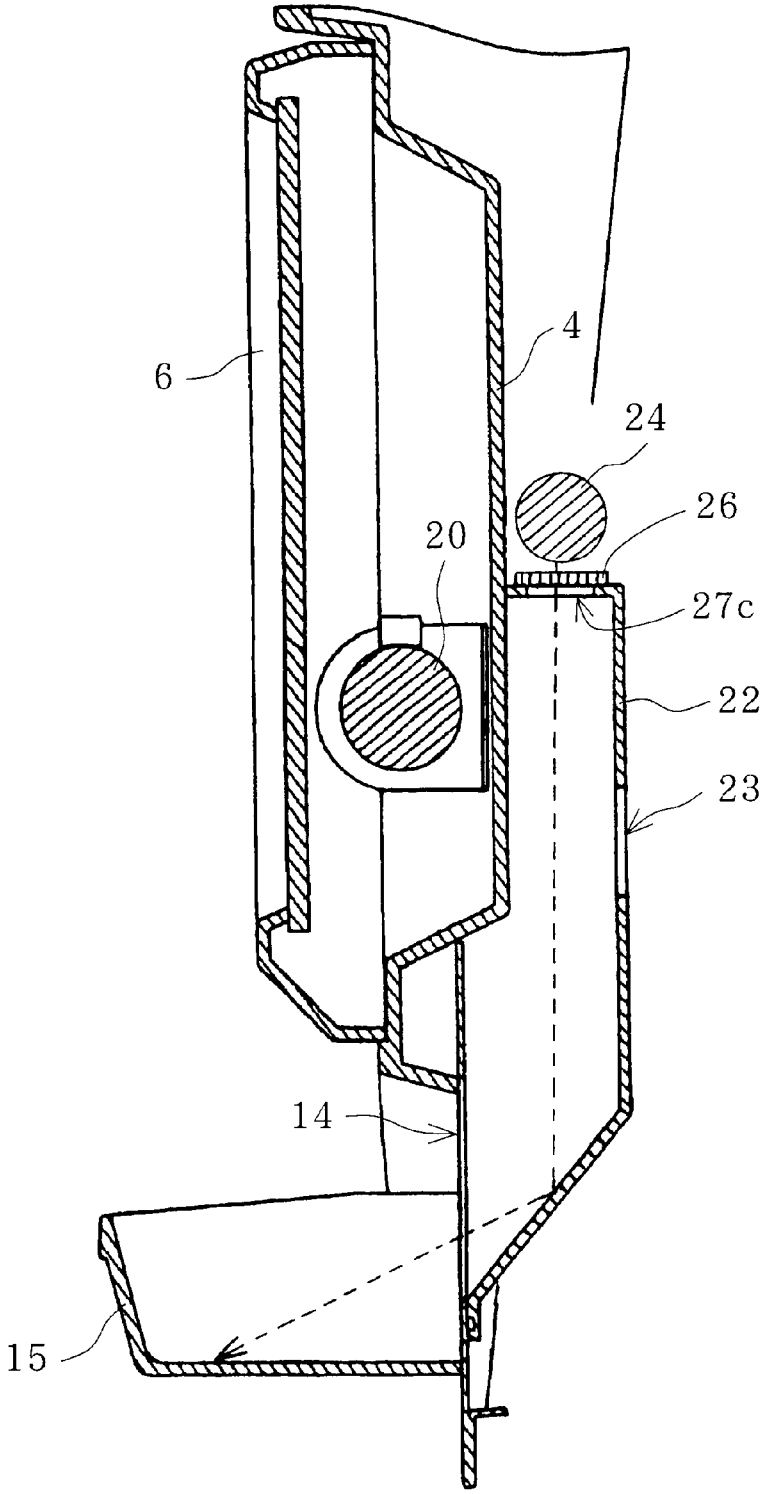
FIG. 7 is a partially cross-sectional side representation showing a fourth embodiment of a longitudinal section of the lower portion of the slot machine of the present invention.

FIG. 7 is a partially cross-sectional side representation showing a fourth embodiment of a longitudinal section of the lower portion of the slot machine of the present invention. As shown in this figure, second light source 24 is disposed at the upper position of chute 22, and the light from light source 24 is shown to enter the chute 22 via an aperture 27*c* formed at the upper part of chute 22. In accordance with this embodiment of the invention, the light from second light source 24 is passed through aperture 27*c* of chute 22 and thereby is caused to enter chute 22. The light reflected within chute 22 is emitted from outlet 14, and tray 15 is correspondingly illuminated. A dashed line in FIG. 7 is employed to represent to the path of the light. As previously described, any predetermined coloration of light can be supplied by disposing an optical transmission sheet between aperture 27*c* of chute 22 and second light source 24. This invention is not limited to a slot machine as described in the specific illustrative embodiment herein, and additionally can be applied to other forms of gaming machines that pay out gaming media.

By way of example, in a pachinko machine, the illumination arrangement can be disposed in the interior of a pachinko ball outlet, the pachinko ball being the gaming medium. The illumination arrangement of the present invention creates a conspicuous decorative effect when the pachinko ball is paid out, by virtue of reflecting light originating from within the outlet. Such reflecting light is in addition to the illumination obtained via a receiving plate (not shown) which may consist of an upper plate and a lower plate.

Although the invention has been described in terms of specific embodiments and applications, persons skilled in the art can, in light of this teaching, generate additional embodiments without exceeding the scope or departing from the spirit of the claimed invention. Accordingly, it is to be understood that the drawing and description in this disclosure are proffered to facilitate comprehension of the invention, and should not be construed to limit the scope thereof

What is claimed is:

1. A gaming machine having an outlet for paying out gaming media, and a receiver for receiving the paid-out gaming media, the receiver being disposed outward of the outlet with respect to the gaming machine, the gaming machine comprising:

an illumination arrangement for emitting light;

a first light path for defining a first path of propagation of a first portion of the light issued by said illumination arrangement, said first path of propagation extending to the receiver;

a second light path for defining a second path of propagation of a second portion of the light issued by said illumination arrangement;

an aperture disposed in the first path of propagation for introducing the light emitted by said internal light source into the interior of the outlet; and a reflection surface for reflecting the light toward the outlet, thereby illuminating the receiver from the interior of the outlet.

2. The gaming machine of claim 1, wherein the gaming machine is further provided with a chute for forming as a passage for the gaming media and disposed behind the outlet for paying out gaming media, said reflection surface being formed in the interior of the chute.

3. The gaming machine of claim 1, wherein the gaming machine is provided with a decorative panel disposed on the front of the gaming machine, the second light path being configured to extend to the decorative panel.

4. The gaming machine of claim 1, wherein there is further provided a translucent board in the first path of propagation, the first portion of the light being propagated through said translucent board.

5. The gaming machine of claim 4, wherein said translucent board has a predetermined color characteristic whereby the color characteristic of the first portion of the light issued by said illumination arrangement is changed as it propagates therethrough.

6. The gaming machine of claim 4, wherein said illumination arrangement comprises:

a first internal light source for emitting the first portion of the light issued by said illumination arrangement; and a second internal light source for emitting the second portion of the light issued by said illumination arrangement.

7. The gaming machine of claim 6, wherein said first and second internal light sources have respective color characteristics.

8. The gaming machine of claim 6, wherein said first and second internal light sources are individually actuatable.

9. The gaming machine of claim 6, wherein the gaming machine is further provided with a chute for forming as a passage for the gaming media and said first and second internal light sources are disposed outside of the chute.

10. The gaming machine of claim 9, wherein there is further provided an aperture disposed in a wall of the chute and in the first path of propagation for introducing the light emitted by said first internal light source into the interior of the outlet.

11. A gaming machine having an outlet for paying out gaming media, and a receiver for receiving the paid-out gaming media, the receiver being disposed outward of the outlet with respect to the gaming machine, the gaming machine comprising:

an illumination arrangement for emitting light;

a chute for forming a passage for the gaming media;

a first light path for defining a first path of propagation of a first portion of the light issued by said illumination arrangement, said first path of propagation extending to the receiver;

an aperture disposed in a wall of said chute introducing the light emitted by said internal light source into the interior of the outlet;

a second light path for defining a second path of propagation of a second portion of the light issued by said illumination arrangement;

a decorative panel disposed on the front of the gaming machine, the second light path extending to the decorative panel.

* * * * *